United States Patent [19]

Weisz

[11] Patent Number: 4,487,141

[45] Date of Patent: Dec. 11, 1984

[54] FORCE AMPLIFYING ARRANGEMENT FOR SEWING MACHINE PUSHBUTTON CONTROL

[75] Inventor: William Weisz, Tenafly, N.J.

[73] Assignee: The Singer Company, Stamford, Conn.

[21] Appl. No.: 614,581

[22] Filed: May 29, 1984

[51] Int. Cl.[3] ..... D05B 3/02

[52] U.S. Cl. ..... 112/158 C

[58] Field of Search ..... 112/158 C, 158 A, 158 D, 112/158 B, 158 R, 158 E

[56] References Cited

U.S. PATENT DOCUMENTS

| | | | |
|---|---|---|---|
| 3,217,677 | 11/1965 | Eguchi . | |
| 3,279,402 | 10/1966 | Eguchi . | |
| 4,297,956 | 11/1981 | Meier . | |
| 4,441,440 | 4/1984 | Weisz | 112/158 C |
| 4,453,478 | 6/1984 | Weisz | 112/158 B X |

*Primary Examiner*—Peter Nerbun

*Attorney, Agent, or Firm*—William V. Ebs; Robert E. Smith; Edward L. Bell

[57] ABSTRACT

A sewing machine pushbutton control is provided in a floating extension with a toggle which assists the movement of a plurality of cam followers into operative engagement with buttonhole controlling cams and actuating mechanism for a needle bar and feed regulator.

8 Claims, 5 Drawing Figures

FORCE AMPLIFYING ARRANGEMENT FOR SEWING MACHINE PUSHBUTTON CONTROL

BACKGROUND OF THE INVENTION

1. Field of the Invention

The invention relates to pushbutton controls for sewing machines.

2. Description of the Prior Art

In a pushbutton control such as shown, for example, in my U.S. Pat. No. 4,441,440 for "Push-Button Control Module for a Sewing Machine" issued Apr. 10, 1984, a pushbutton for use in selecting a buttonhole sewing operation is required to initiate several control functions simultaneously, and several reaction forces combine to make it uncomfortable for an operator to move the pushbutton into a depressed position.

It is a prime object of the invention in a sewing machine, wherein pushbuttons mechanically control the operation of the machine, to enable an operator to easily overcome combined reaction forces on a pushbutton which is required to initiate several control functions simultaneously, and so move the pushbutton into a machine activating position.

It is another object of the invention, in a sewing machine wherein pushbuttons mechanically control the operation of the machine, to enable an operator to easily depress a pushbutton controlling buttonhole sewing into a machine activating position.

It is still another object of the invention to mechanically assist the movement by a pushbutton of cam followers into operative engagement with associated cams and actuating mechanism for the needle bar and feed regulator of a sewing machine.

Other objects and advantages of the invention will become apparent during a reading of the specification taken in conjunction with the accompanying drawings.

SUMMARY OF THE INVENTION

A sewing machine according to the invention includes a needle bar, mechanism for displacing the needle bar, feed regulating mechanism, a plurality of cams, a cam follower for each cam, a pushbutton inwardly movable against one of the cam followers for operably connecting the associated cam with one of the said mechanisms, a floating extension for said pushbutton inwardly movable by the pushbutton, and a toggle which is movable by the floating extension. One end of the toggle is disposed for engagement with fixed structure, whereas the other end is disposed to engage a second follower, as the floating extension is moved inwardly by the pushbutton, and operably connect the second follower associated cam with the other of said mechanisms.

DESCRIPTION OF THE PREFERRED EMBODIMENT

Figure 1:
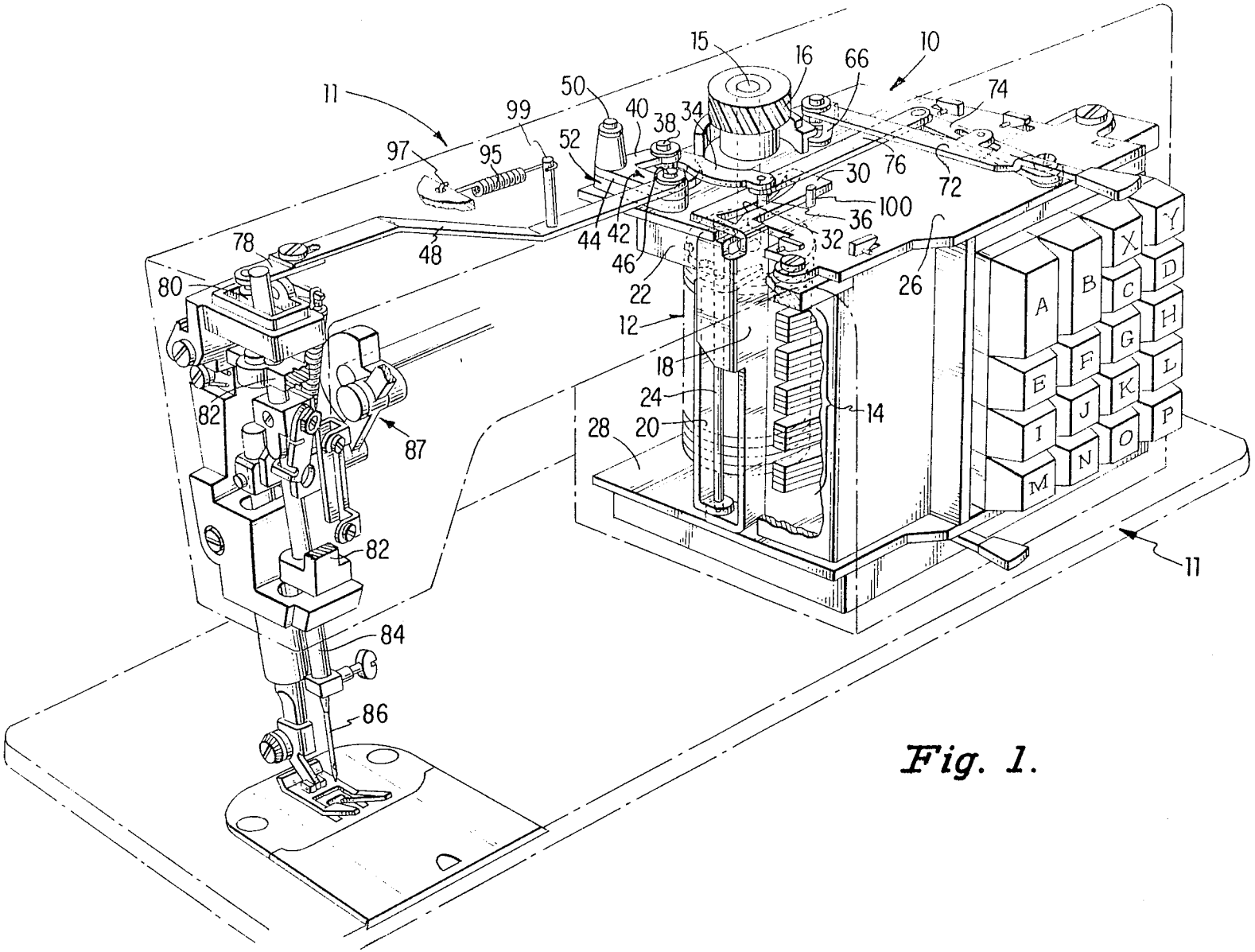
FIG. 1 is a perspective view showing a sewing machine pushbutton module including mechanism according to the invention, and a needle gate controlled thereby.

Referring to the drawings, reference character 10 designates a sewing machine pushbutton control module which is generally of the kind shown in U.S. Pat. No. 4,441,440. The module, which is to be understood as being affixed in a machine 11, includes sewing mode selecting pushbuttons A and B for straight and zigzag sewing respectively, pushbuttons C through P for pattern sewing, and pushbuttons X and Y for buttonhole sewing. The module includes a stack 12 of rotatable cams, and a stack 14 of pivotally mounted cam followers. The cams are rotatable by a shaft 15 which is driven by a gear 16 during operation of the machine. Each of the cam followers can be positioned by selective operation of the pushbuttons into engagement at one end with an associated cam of the cam stack, and at the other end with a needle plate 18, feed wobble plate 20 or crank 22. A shaft 24, affixed in a top plate 26 and bottom plate 28 of the module, defines a common axis about which needle plate 18, feed wobble plate 20 and crank 22 may be pivoted by the cam followers.

Needle plate 18 terminates at its upper end in a bracket 30 which includes a circularly extending arcuate slot 32. One end of a link 34 carries a pin 36 which extends into slot 32, and the opposite end is pivotally connected by a pin 38 to one arm 40 of a bell crank 42 at a center defining the arcuate outline of slot 32. The other arm 44 of the bell crank is pivotally connected at 46 to a needle bar actuating link 48. Bell crank 42 is pivotally mounted between arms 40 and 44 on a stub shaft 50 affixed in a carrier 52. The carrier is pivotally supported on a pin 54 which is located in top plate 26 of module 10 to establish a fixed pivotal axis for the carrier. A pin 56 in an arm 58 of carrier 52 connects the carrier with crank 22 at a slot 59 therein. Another arm 60 of the carrier includes a curved end portion 62 with a terminal slot 64. A latch 66 pivotally mounted on plate 26 at 68 includes an end key 70 engageable at slot 64 with carrier arm 60 for locking the carrier in a fixed position on plate 26 and disengageable from said arm for unlocking the carrier to enable movement of the carrier about its pivotal axis. Latch 66 is normally disposed by a spring 71 with key 70 in slot 64 to lock the carrier 52 in a fixed position on plate 26. The carrier is unlocked by the depression of button X or Y.

Pin 36 is positionable in slot 32 on needle plate 18 with a lever 72 acting through links 74 and 76, and for any particular position of pin 36 in slot 32, the pin is rocked by needle plate 18 about the axis of shaft 24 in response to pivotal movement of plate 18 as determined by a selected follower and actuating cam. Movement of the pin 36 is transmitted through link 34 to bell crank 42 which is thereby caused to pivot on stub shaft 50 and move needle bar actuating link 48 accordingly. As will be made apparent hereinafter, movement of crank 22 by a cam follower can occur only while carrier 52 is unlocked. Movement may then be imparted to the carrier about its pivotal axis by crank 22, and to the pivotal axis of bell crank 42 by the carrier. As the pivotal axis of the bell crank 42 is moved, needle bar actuating link 48 which is pivoted on arm 44 of the bell crank is moved accordingly.

As shown, needle bar actuating link 48 connects through an adjustable extension 78 with a needle bar post 80. Link 48 acts through extension 78 and needle bar post 80 to laterally move gate 82 and needle bar 84 as a needle 86 is reciprocated endwise by driving mechanism 87 which is operably connected to the needle bar.

Figure 2:
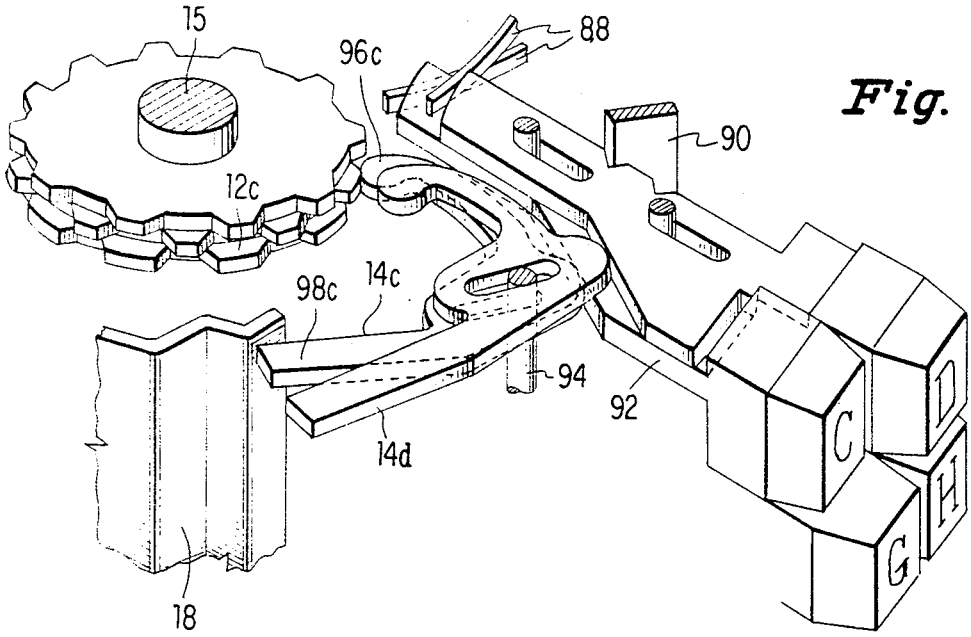
FIGS. 2 and 3 are fragmentary perspective views illustrating pushbutton functions in said module.

Any pushbutton of module 10 may be depressed into a position wherein it is held against the outward bias of an associated spring 88 by a latch 90, and when so depressed, any button previously moved into a latched position is released and returned by its spring to a normal unactuated position, all as described in U.S. Pat. No. 4,441,440, mentioned hereinbefore. Assuming a pushbutton for pattern sewing, such as pushbutton C, is moved into a latched position (FIG. 2), an associated cam follower $14_c$ is caused to ride up along an edge of an extension 92 of the pushbutton and move on pin 94 into an activated position of enforced engagement at one end $96_c$ with an associated cam $12_c$ and at the opposite end $98_c$ with needle plate 18. The cam follower is moved into such activated position against the reactive force of a spring 95 having one end grounded in the machine at 97 and the other end extending about a pin 99 which is affixed to link 48, the spring being effective through link 48, bell crank 42, link 34, pin 36 and bracket 30 to bias needle plate 18 toward a limiting position defined by engagement of the bracket 30 with a fixed stop 100. During the rotation of shaft 15 by gear 16, the follower is rocked in a manner predetermined by the profile of the cam about the pushbutton extension serving as a supporting fulcrum. The follower positions and imparts pivotal movement to needle plate 18 and the needle plate acting through bracket 30, pin 36, link 34, bell crank 42, needle bar actuating link 48, needle bar post 80 and gate 82 controls the positioning and side-to-side movement of the needle bar. The carrier 52 is locked in a fixed position on plate 26 at such time and does not influence the motion of the needle bar.

Figure 3:
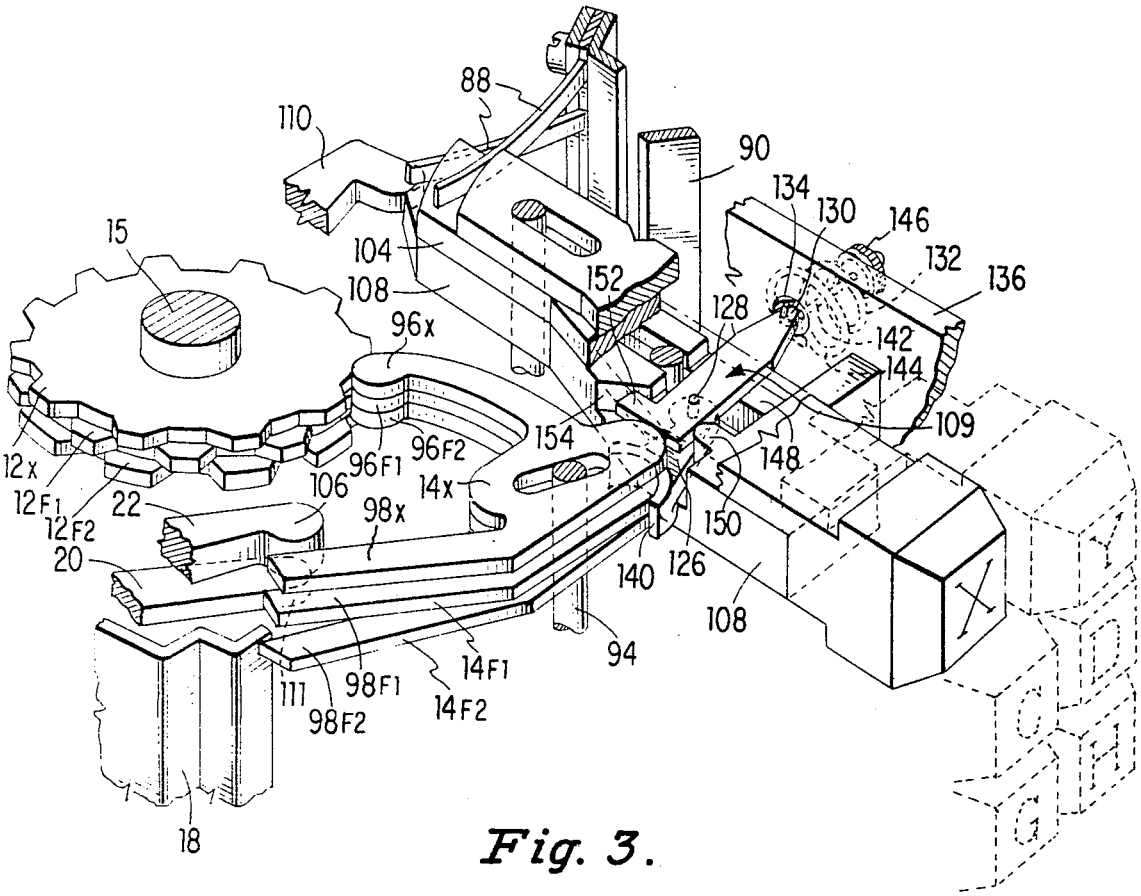
Figure 4:
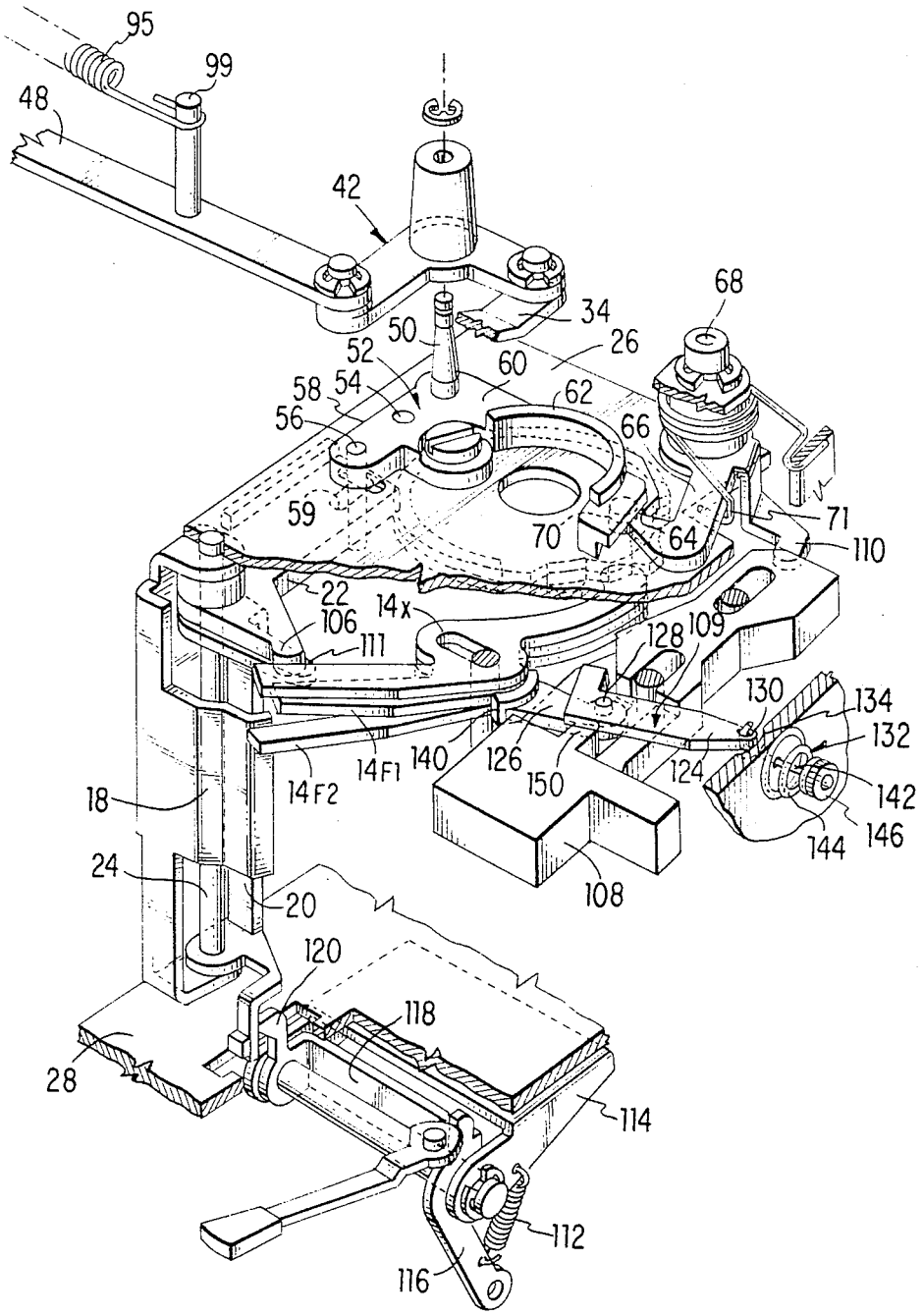
FIG. 4 is a perspective view showing module portions which include mechanism according to the invention.
Figure 5:
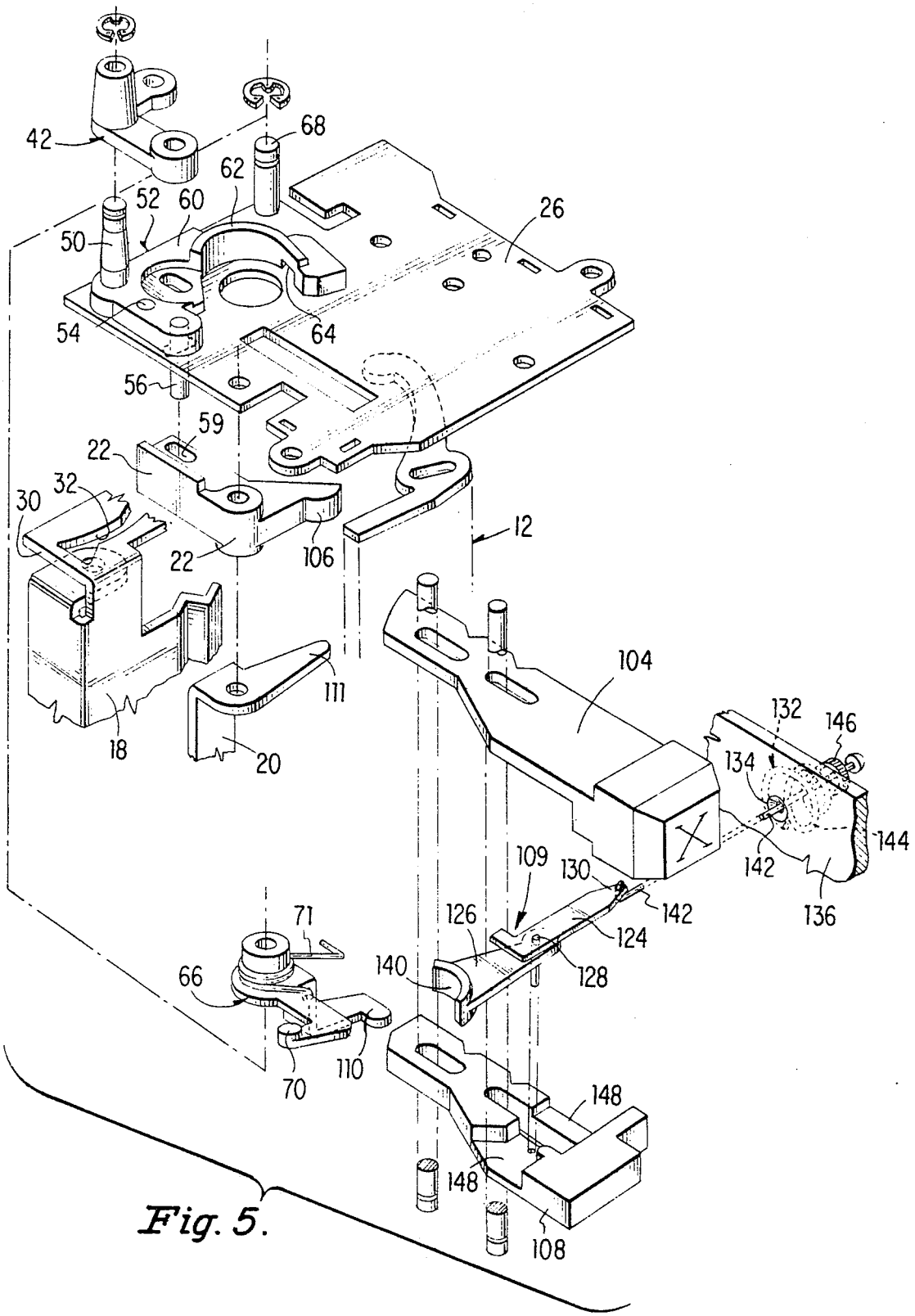
FIG. 5 is an exploded perspective view showing the mechanism of the invention.

When a pushbutton for initiating buttonhole sewing, as for example the pushbutton X, is depressed to a latched position (FIG. 3), an extended portion 104 of such pushbutton moves an associated cam follower $14_x$ to a supported position thereon, and thereby into forced engagement at opposite ends $96_x$ and $98_x$ with a buttonhole cam $12_x$ and one end 106 of crank 22, respectively. At the same time, a floating extension 108, operable by either pushbutton X or Y, is moved by button X against a toggle 109 which is thereby caused to dispose two other cam followers $14_{F1}$ and $14_{F2}$ into activated toggle supported positions of enforced engagement at ends $96_{F1}$ and $96_{F2}$ with associated buttonhole cams $12_{F1}$ and $12_{F2}$ respectively, and at opposite ends $98_{F1}$ and $98_{F2}$ with feed wobble plate 20 and needle plate 18, respectively. Floating extension 108 is also caused by the depression of button X to act against an arm 110 on latch 66, and move the latch 66 against the bias of spring 71 as required to unlock the carrier 52. Follower $14_x$ is moved into its activated position of enforced engagement with crank 22 against a reactive force due to the bias of spring 95 acting through link 48, bell crank 42, carrier 52, and the crank 22. Follower $14_{F1}$ is moved to its activated position of enforced engagement with feed wobble plate 20 at 111 in opposition to the reactive force of a spring 112 which is connected at opposite ends to fixed structure 114 of module 18 and a bracket arm 116, and which exerts a bias through bracket 118 and finger 120 on the feed wobble plate. Follower $14_{F2}$ is moved to its activated position of enforced engagement with needle plate 18 against the reactive force of spring 95 acting through link 48, bell crank 42, link 34, pin 36, bracket 30 and the needle plate.

As cam shaft 15 is rotated, crank 22, needle plate 18 and feed wobble plate 20 are moved by the engaging followers in accordance with the profiles of the buttonhole cams. The buttonhole cams are of a well known type used in buttonhole sewing, the buttonhole cam in engagement with the crank associated follower being a needle positioning and barring cam, the buttonhole cam in engagement with the feed wobble plate associated follower being a feed direction controlling cam, and the other buttonhole cam being a needle zigzag cam. Clutching and tripping control means (not shown) of a kind such as disclosed in U.S. Pat. No. 3,841,246 of John W. Casner et al issued Oct. 15, 1974, drivably connect and disconnect the needle positioning and barring cam to and from cam shaft 15 during the sewing of a buttonhole as required to effect the formation of a buttonhole of a predetermined length.

As crank 22 is moved by the engaging follower, carrier 52 is pivoted by the crank acting thereon through pin 56 and moves the pivotal axis of bell crank 42 to influence needle bar 84 to which the bell crank is connected through needle bar actuating link 48, needle bar post 80 and gate 82. Needle plate 18 acting through bracket 30, pin 36, and link 34 pivots the bell crank on stub shaft 50 and thereby also influences movement of the needle bar. Feed wobble plate 20 acting through bracket finger 120, bracket 118 and arm 116 positions feed regulating mechanism (not shown) suitably connected to arm 116 to provide for the feeding of material in a forward and reverse direction during the formation of a buttonhole. Such feed regulating mechanism may be of the kind shown, for example, in U.S. Pat. No. 3,527,183 for "Work Feeding Mechanism for Sewing Machine" of Jan Szostak, issued Sept. 8, 1970.

Toggle 109 may be seen to include two links 124 and 126 which are pivotally connected to one another by a pin 128. One end 130 of the toggle is biased by a spring 132 against a spherical seat 134 formed in a fixed plate 136 of module 10. The other end of the toggle includes a shoe 140 engageable with cam followers $14_{F1}$ and $14_{F2}$. As shown, spring 132 includes a straight portion 142 and coils 144. Straight portion 142 connects with toggle end 130 and extends therefrom through plate 136 to connect at 146 with the coils 144. The coils bear against the plate. As shown, toggle 109 extends through a recess 148 in floating extension 108, and is engaged therein on link 124 by a finger 150 formed on the floating extension. As the floating extension is moved by a buttonhole controlling pushbutton such as X, finger 150 causes the toggle to apply pressure at the shoe 140 to the cam followers $14_{F1}$ and $14_{F2}$ operably associated therewith, and dispose such cam followers in their activated positions where they are retained by the toggle until released by the operation of another pushbutton. Finger 150 is situated to engage link 124 at a location which is such as to enable the toggle to overcome reaction forces against the cam followers with much less force than would otherwise be required of an operator at the pushbutton. The toggle is prevented from being moved over center by the engagement of a foot 152 on link 124 with an oblique surface 154 on the floating extension. When a new pushbutton from the group A through P is depressed, pushbutton X and floating extension 108 are returned to unactivated positions by a spring 88 and spring 71, respectively. The toggle is released by the retraction of finger 150, and the toggle engaged cam followers $14_{F1}$ and $14_{F2}$ are moved out of their activated positions by the reactive forces due to springs 112 and 95, respectively. The cam follower $14_x$ actuated by direct engagement with pushbutton X is also moved out of its actuation position by the reactive force of spring 95.

It is to be understood that the present disclosure relates to a preferred embodiment of the invention which is for purposes of illustration only and is not to be construed as limiting the invention. Numerous alterations and modifications of the structure herein will suggest themselves to those skilled in the art, and all such modifications which do not depart from the spirit and scope of the invention are intended to be included within the scope of the appended claims.

I claim:

1. In a sewing machine, a needle bar, mechanism for displacing the needle bar, feed regulating mechanism, a plurality of cams, a cam follower for each cam, a pushbutton inwardly movable against one of the cam followers for operably connecting the associated cam with one of the said mechanisms, a floating extension for said pushbutton inwardly movable by the pushbutton, a toggle which is movable by the floating extension and has one end disposed for engagement with fixed structure, the opposite end of the toggle being disposed to engage a second follower as the floating extension is moved inwardly by the pushbutton and thereby operably connect the second follower associated cam with the other of said mechanisms.

2. The combination of claim 1 wherein the said one mechanism is the needle bar displacing mechanism and the other is the feed regulating mechanism.

3. The combination of claim 2 wherein the floating extension acts against a third follower to operably connect its associated cam with the needle bar displacing mechanism as the floating extension is moved inwardly by said pushbutton.

4. The combination of claim 3 wherein the associated cam of said one cam follower, second cam follower, and third cam follower are cams profiled to control the sewing of a buttonhole.

5. The combinaton of claim 1 including a latch which is spring biased into a position locking a portion of the needle bar displacing mechanism in a fixed position in the machine, and is movable therefrom by the floating extension.

6. The combination of claim 1 including mutually engageable surfaces on the floating extension and toggle for preventing over-the-center movement of the toggle.

7. The combination of claim 1 including spring means operably connected to said one end of the toggle and to said fixed structure for seating the toggle at the said one end against the fixed structure.

8. The combination of claim 1 wherein the floating extension is recessed and the toggle extends through the recess in said extension.

* * * * *